US010480389B2

(12) United States Patent
Amann

(10) Patent No.: US 10,480,389 B2
(45) Date of Patent: Nov. 19, 2019

(54) COOLANT CIRCUIT FOR A LIQUID-COOLED TRANSMISSION

(71) Applicant: Bayerische Motoren Werke Aktiengesellschaft, Munich (DE)

(72) Inventor: Norbert Amann, Hohenpolding (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 26 days.

(21) Appl. No.: 15/796,922

(22) Filed: Oct. 30, 2017

(65) Prior Publication Data

US 2018/0066566 A1 Mar. 8, 2018

Related U.S. Application Data

(63) Continuation of application No. PCT/EP2016/062934, filed on Jun. 8, 2016.

(30) Foreign Application Priority Data

Jul. 8, 2015 (DE) ..... 10 2015 212 733

(51) Int. Cl.
*F01P 3/20* (2006.01)
*F01P 3/06* (2006.01)
(Continued)

(52) U.S. Cl.
CPC ..... *F01P 3/20* (2013.01); *F01P 3/06* (2013.01); *F01P 3/12* (2013.01); *F01P 7/14* (2013.01);
(Continued)

(58) Field of Classification Search
CPC ..... F01P 3/20; F01P 3/06; F01P 3/12; F01P 7/14; F01P 2003/027; F01P 2007/146; F01P 2025/62; F01P 2025/64; F01P 2060/045
(Continued)

(56) References Cited

U.S. PATENT DOCUMENTS 6,427,640 B1 8/2002 Hickey et al.
8,464,668 B2 6/2013 DiPaola et al.
(Continued)

FOREIGN PATENT DOCUMENTS

DE 10 2009 001 129 A1 9/2010
DE 10 2014 201 017 A1 7/2014
(Continued)

OTHER PUBLICATIONS

International Search Report (PCT/ISA/210) issued in PCT Application No. PCT/EP2016/062934 dated Aug. 16, 2016 with English translation (six (6) pages).
(Continued)

*Primary Examiner* — Lindsay M Low
*Assistant Examiner* — Yi-Kai Wang
(74) *Attorney, Agent, or Firm* — Crowell & Moring LLP

(57) ABSTRACT

A coolant circuit has an engine cooling circuit in which coolant can be circulated in order to cool an internal combustion engine via a cylinder head cooling circuit and a crankcase cooling circuit separated from the cylinder head cooling circuit. The coolant circuit includes a transmission cooling circuit for cooling a transmission, the transmission cooling circuit branching off from the engine cooling circuit. A valve is arranged in the transmission cooling circuit. A controller is designed to open and close the valve depending on an operating state of the internal combustion engine and/or the transmission. In particular, the transmission cooling circuit branches off from the crankcase cooling circuit to a section along which the crankcase cooling circuit is separated from the cylinder head cooling circuit.

13 Claims, 3 Drawing Sheets

(51) Int. Cl.
*F01P 3/12* (2006.01)
*F01P 7/14* (2006.01)
*F01P 3/02* (2006.01)

(52) U.S. Cl.
CPC ... *F01P 2003/027* (2013.01); *F01P 2007/146* (2013.01); *F01P 2025/62* (2013.01); *F01P 2025/64* (2013.01); *F01P 2060/045* (2013.01)

(58) Field of Classification Search
USPC ..... 123/41.08
See application file for complete search history.

(56) References Cited

U.S. PATENT DOCUMENTS

| | | | | |
|---|---|---|---|---|
| 2003/0101961 | A1* | 6/2003 | Foster | B60H 1/00314 123/198 F |
| 2009/0114171 | A1 | 5/2009 | Hayashi | |
| 2013/0186351 | A1* | 7/2013 | Quix | F01P 5/10 123/41.02 |
| 2013/0319806 | A1* | 12/2013 | Schindler | F16H 63/3483 188/353 |
| 2014/0020641 | A1* | 1/2014 | Shimoyama | F01P 7/14 123/41.52 |
| 2014/0352636 | A1* | 12/2014 | Glassford | F01P 3/12 123/41.08 |
| 2015/0080179 | A1 | 3/2015 | Gonze et al. | |
| 2017/0241324 | A1* | 8/2017 | Liu | F01P 5/10 |
| 2018/0298806 | A1* | 10/2018 | Sutherland | F01P 7/14 |

FOREIGN PATENT DOCUMENTS

| | | | |
|---|---|---|---|
| DE | 10 2013 217 154 | A1 | 3/2015 |
| DE | 10 2014 112 094 | A1 | 3/2015 |
| DE | 20 2015 101 010 | U1 | 3/2015 |
| EP | 0 736 703 | A1 | 10/1996 |
| EP | 1 522 689 | A1 | 4/2005 |
| JP | 2014-145326 | A | 8/2014 |

OTHER PUBLICATIONS

German-language Office Action issued in counterpart German Application No. 10 2015 212 733.8 dated Mar. 2, 2016 (six (6) pages).
German-language Written Opinion (PCT/ISA/210) issued in PCT Application No. PCT/EP2016/062934 dated Jun. 8, 2016 (five (5) pages).

* cited by examiner

COOLANT CIRCUIT FOR A LIQUID-COOLED TRANSMISSION

CROSS REFERENCE TO RELATED APPLICATIONS

This application is a continuation of PCT International Application No. PCT/EP2016/062934, filed Jun. 8, 2016, which claims priority under 35 U.S.C. § 119 from German Patent Application No. 10 2015 212 733.8, filed Jul. 8, 2015, the entire disclosures of which are herein expressly incorporated by reference.

BACKGROUND AND SUMMARY OF THE INVENTION

The invention relates to a coolant circuit having an engine cooling circuit and a transmission cooling circuit which branches off from the engine cooling circuit.

Modern high-performance transmissions, in particular dual-clutch transmissions, are also cooled with water in addition to oil cooling. In this instance, coolant is branched off from the engine cooling circuit and used to cool the transmission. However, it has been found with this type of cooling that over wide operating ranges the relatively warm coolant in the coolant circuit leads to the transmission being actually heated in certain operating ranges rather than cooled. Only in high power ranges is this effect reversed so that the transmission is cooled.

There is therefore a needed an improved cooling of liquid-cooled transmissions.

An object of the present invention is to provide a coolant circuit for cooling a transmission which has improved cooling properties. This object is achieved with a coolant circuit, a motor vehicle having the coolant circuit, and a control method of controlling the coolant circuit in accordance with embodiments of the invention.

According to an embodiment of the invention, a coolant circuit is provided having an engine cooling circuit in which coolant can be circulated in order to cool an internal combustion engine; having a transmission cooling circuit for cooling a transmission which branches off from the engine cooling circuit; having a valve which is arranged at least in the transmission cooling circuit, and having a control which is adapted to open and close the valve in accordance with an operating state of the internal combustion engine and/or the transmission. The operating state of the internal combustion engine may, for example, be determined by way of a throttle valve position, an engine speed and/or an engine torque. Furthermore, the control may be adapted to control (to open and close) the valve in accordance with at least one of the following parameters: a coolant temperature, a crank housing temperature.

As described in the introduction, it has been found that conventional coolant circuits at low engine power heat, rather than cool, the transmission. Furthermore, this also has a negative influence on the heating speed of the internal combustion engine in the warm-up phase, which may have an influence on emissions and fuel consumption. This is prevented by the provision of a possible method for switching off the transmission cooling circuit in accordance with the engine power. Since, at high engine power, the transmission can be cooled very effectively by the coolant, from a specific engine power from which the cooling action takes effect, a flow of coolant through the transmission cooling circuit is permitted.

According to another embodiment of the invention, the engine cooling circuit comprises a cylinder head cooling circuit and separately therefrom a crank housing cooling circuit, wherein the transmission cooling circuit branches off from the crank housing cooling circuit, that is to say, branches off at a portion along which the crank housing cooling circuit is separated from the cylinder head cooling circuit. The advantage which is afforded by this coolant switching is that, with so-called split cooling engines in which a separate crank housing and cylinder head cooling circuit is provided, the cylinder head cooling circuit has a permanent throughflow and it is sufficient for the crank housing cooling circuit to be flowed through only from a specific engine power. The inventor of this invention discovered that by coupling the transmission cooling circuit to the crank housing cooling circuit, an additional separate valve for the transmission cooling circuit can be saved since the crank housing and the transmission have similar cooling conditions and consequently a common valve for the transmission cooling circuit and the crank housing cooling circuit can be used. In this embodiment, the valve (the same valve) is consequently arranged in the transmission cooling circuit and in the crank housing cooling circuit, that is to say, the transmission cooling circuit and the crank housing circuit are identical at least at the input or at the output of the valve.

According to another embodiment of the invention, a coolant circuit is provided, wherein the crank housing cooling circuit has a crank housing water jacket which is guided around cylinder bores, and the transmission cooling circuit opens in the crank housing water jacket downstream of a device for absorbing heat from the transmission, in particular a water jacket in the transmission housing or a heat exchanger for heat transmission with the transmission oil. In particular, the valve is located downstream of the crank housing water jacket.

According to another embodiment of the invention, downstream of the valve the cylinder head cooling circuit and the crank housing cooling circuit are merged again.

According to another embodiment of the invention, the engine cooling circuit branches off at a branch into the cylinder head cooling circuit and the crank housing cooling circuit, wherein the transmission cooling circuit branches off downstream of the branch from the crank housing cooling circuit.

According to another embodiment of the invention, the transmission cooling circuit branches off from the crank housing cooling circuit downstream of the branch and upstream of a crank housing water jacket of the crank housing cooling circuit.

According to another embodiment of the invention, a coolant circuit is provided, wherein the crank housing cooling circuit branches off downstream of the branch into a crank housing water jacket and an engine oil cooling circuit which is adapted to cool an engine oil via a heat exchanger. The transmission cooling circuit branches off from the engine oil cooling circuit.

According to another embodiment of the invention, a non-return valve is provided in the transmission cooling circuit. This non-return valve is intended to prevent, in particular in the split cooling system, flow through the crank housing water jacket and in the reverse direction the transmission cooling circuit when the transmission cooling circuit valve is closed.

According to another embodiment of the invention, the branch is formed by a coolant pump.

According to another embodiment, the control is adapted to open and close the valve in accordance with an engine speed and/or an engine torque. Furthermore, the control may be adapted to control (open and close) the valve in accordance with at least one of the following parameters: a coolant temperature, a crank housing temperature.

According to another embodiment, the control is adapted to open the valve only above a specific threshold value of the engine speed and/or the engine torque. This means that the control is adapted to open the valve above the threshold value and to close the valve below the threshold value (including the threshold value itself). In particular, the control is adapted to completely open the valve above the threshold value and to completely close the valve below the threshold value (including the threshold value itself). The engine speed and the engine torque determine an engine power. In this instance, the control may be adapted to open the valve only above a threshold value of the engine power of 70% of the maximum engine power, the so-called nominal engine power. In particular the threshold value is 80%.

Furthermore, the invention relates to a vehicle having a coolant circuit according to one of the embodiments.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
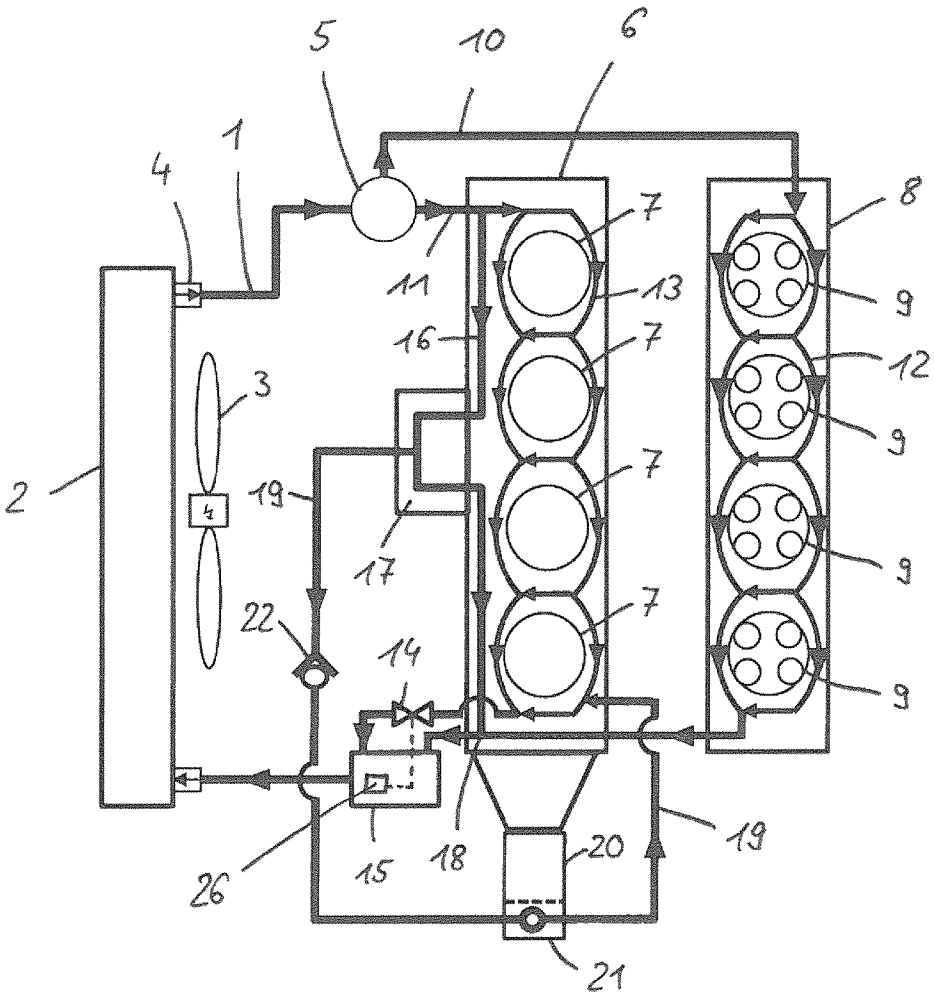
FIG. 1 is a schematic view of a first embodiment of the coolant circuit according to the present invention.

FIG. 1 is a schematic view of a first embodiment of the coolant circuit according to the present invention. In particular, in motor vehicles coolant (for example, a mixture of glycol and water) flows through this coolant circuit in order to cool an internal combustion engine and a liquid-cooled transmission, in particular a dual-clutch transmission. Flow directions are identified in all the Figures with corresponding arrows in the respective flow paths.

The coolant circuit 1 comprises an engine cooling circuit and a transmission cooling circuit which extend together through a radiator 2. The radiator 2 can be cooled in a known manner, in addition to the travel wind, by a fan 3. The radiator 2 cools coolant which is guided in the coolant circuit in a known manner. From a radiator outlet 4, the coolant circuit 1 extends further to a coolant pump 5, which may be a coolant pump 5 which is mechanically driven by an internal combustion engine or an electrically driven coolant pump. The internal combustion engine comprises a crank housing 6 with a plurality of cylinder bores 7 and a cylinder head housing 8 with the cylinder heads 9 corresponding to the cylinder bores 7. The coolant circuit 1 is divided at a branch, which in this embodiment is formed by the coolant pump 5, into a cylinder head cooling circuit 10 and a crank housing cooling circuit 11. However, the branch may also be formed further downstream of the coolant pump 5 by a coolant line branch.

Within the crank housing 6 and the cylinder head housing 8, cooling channels, which are guided in the form of a water jacket around each cylinder bore 7 or each cylinder head 9, are in each case formed in the housing material. This crank housing water jacket 13 or cylinder head water jacket 12 is formed by way of hollow spaces which extend over a specific height of the cylinder bores 7 or cylinder heads 9 and which surround the cylinder bores or cylinder heads in an annular manner. These annular hollow spaces are connected in series to each other. Furthermore, these hollow spaces, which are connected to each other, are connected to a supply and a discharge. For example, of the two outer hollow spaces, one is connected to a supply and the other to a discharge. After the division into the cylinder head cooling circuit 10 and crank housing cooling circuit 11, the cylinder head cooling circuit 10 leads through the cylinder head water jacket 12 and the crank housing circuit 11 leads through the crank housing water jacket 13.

At the output of the crank housing water jacket 13, the crank housing cooling circuit 11 leads to a valve 14. In the closed state, the valve 14 stops the flow of coolant in the crank housing water jacket 13 and, in the open state, permits the flow of coolant through the crank housing water jacket 13. Preferably, the valve 14 has, with respect to the coolant, a single input and a maximum of two outputs. The valve 14 may, for example, be able to be actuated electromagnetically, for example, using an electromotive worm drive. The output of the valve 14 leads into a heat management module 15 which is responsible for the control of the coolant circuit 1 and from there back into the radiator 2 again.

Between the coolant pump 5 (or the branch) and the input to the crank housing water jacket 13, an engine cooling circuit 16 branches off which is constructed as a channel separately from the crank housing water jacket 13 in the crank housing 6. The engine cooling circuit 16 extends through an engine oil water heat exchanger 17 in which the coolant cools an engine oil which lubricates and cools moving components of the internal combustion engine. To this end, on the one hand, the engine cooling circuit 16 flows through the engine oil water heat exchanger 17 and separately therefrom an engine oil circuit which is not illustrated. Downstream of the engine oil water heat exchanger 17, the engine oil cooling circuit 16 is merged at a location 18 with the cylinder head cooling circuit 10 which originates from the output of the cylinder head cooling circuit 12 and is directed further to the heat management module 15, and after which it is guided back to the radiator 2.

From the engine oil cooling circuit 16, a transmission cooling circuit 19 branches off in order to cool a transmission 20, which is, for example, a dual-clutch transmission. FIG. 1 shows that the transmission cooling circuit 19 branches off in the region of the engine oil water heat exchanger 17. However, the transmission cooling circuit 19 may branch off at any location between the coolant pump 5 (or the branch) and the location 18 of the motor oil cooling circuit 16. The transmission cooling circuit 19 may also branch off from the crank housing water jacket 13. The transmission cooling circuit 19 may also branch off directly (indirectly is illustrated in FIG. 1) from the crank housing cooling circuit 11 between the coolant pump 5 (or the branch) and the input to the crank housing water jacket 13. Preferably, the transmission cooling circuit 19 branches off from the crank housing cooling circuit 11, in particular at a location which is suitable in practice for such a connection. The transmission cooling circuit 19 leads to a device 21 for heat absorption from the transmission 20, in particular a dual-clutch transmission. This device 21 is, in this embodiment, a water jacket which is constructed in the transmission housing and which, similarly to the above-described water jackets, is guided around hot components of the transmission 20. Depending on the type of transmission, the device 21 could also be a heat exchanger which cools a transmission oil. Downstream of the device 21, the transmission circuit 19 opens in the crank housing water jacket 13, preferably in the region of the output and preferably at the warmer side of the water jacket.

The valve 14 which is arranged at the output of the crank housing water jacket 13 is, as a result of the introduction of the transmission cooling circuit 19 in the crank housing water jacket 13, consequently also arranged in the transmission cooling circuit 19. If the valve 14 is closed, a coolant flow is also prevented in the transmission cooling circuit 19. If the valve 14 is opened, this also enables a coolant flow in the transmission cooling circuit 19. In order to prevent a flow in the crank housing water jacket 13 and a return flow in the transmission cooling circuit 19 when the valve 14 is closed, there is provided in the transmission cooling circuit 19 a non-return valve 22 which only permits a flow from the engine oil cooling circuit 16 to the crank housing water jacket 13. This valve 14 is, in this embodiment, opened and closed in accordance with an operating state of the internal combustion engine and/or the transmission. The control of the valve 14 is carried out by a control 26 which may be implemented in the form of an electrical circuit or by way of a processor unit (for example, programmable or pre-programmed).

In FIG. 1, the control 26 is associated with the heat management module 15, but the control 26 may also be an independent control, part of an engine control, the engine control itself or any other suitable control. The control 26 may control the valve 14 in such a manner that it opens or closes in order to consequently control a throughflow quantity through the valve 14. Additionally or alternatively, the control 26 may also control the valve 14 in a timed manner so that it opens and closes with a specific timing in order to consequently achieve a desired throughflow quantity. Furthermore, the control 26 may also control the valve 14 in such a manner that a throughflow cross-section is narrowed or expanded so that a specific throughflow quantity of coolant is achieved.

The basis for the control of the valve 14 by the control 26 is the operating state of the internal combustion engine and/or the transmission. This includes at least one of the following parameters:

- engine speed of the internal combustion engine
- torque of the internal combustion engine
- engine power (is determined by the engine power and the engine torque)
- throttle valve position
- transmission input speed
- transmission output speed
- transmission input torque
- transmission output torque
- coolant temperature (is measured by a temperature sensor)
- crank housing temperature (is measured by a temperature sensor)
- transmission housing temperature (is measured by a temperature sensor).

Preferably, the control 26 is adapted to open and close the valve 14 in accordance with the engine speed and/or the engine torque, wherein one or more of the above-mentioned parameters can also additionally be included in the control. For example, the valve 14 could be controlled in accordance with the engine speed, the engine torque, the coolant temperature and the crank housing temperature. As a result of a specific engine speed and a specific engine torque, an engine power is produced. For example, the valve 14 is opened above a specific engine power and closed below this engine power. More preferably, the valve 14 opens from an engine power of 60%, even more preferably the valve 14 opens from an engine power of 70%, even more preferably the valve 14 opens from an engine power of 80%. The control of the valve 14 may also be implemented in such a manner that in the control 26 specific switching states of the valve 14 are associated with control characteristic curves or control table associations of specific values of the above-mentioned parameters.

It should further be mentioned that, in the closed state of the valve 14, coolant can continue to flow through the engine cooling circuit 16. The valve 14 therefore does not switch the engine oil cooling circuit 16.

Figure 2:
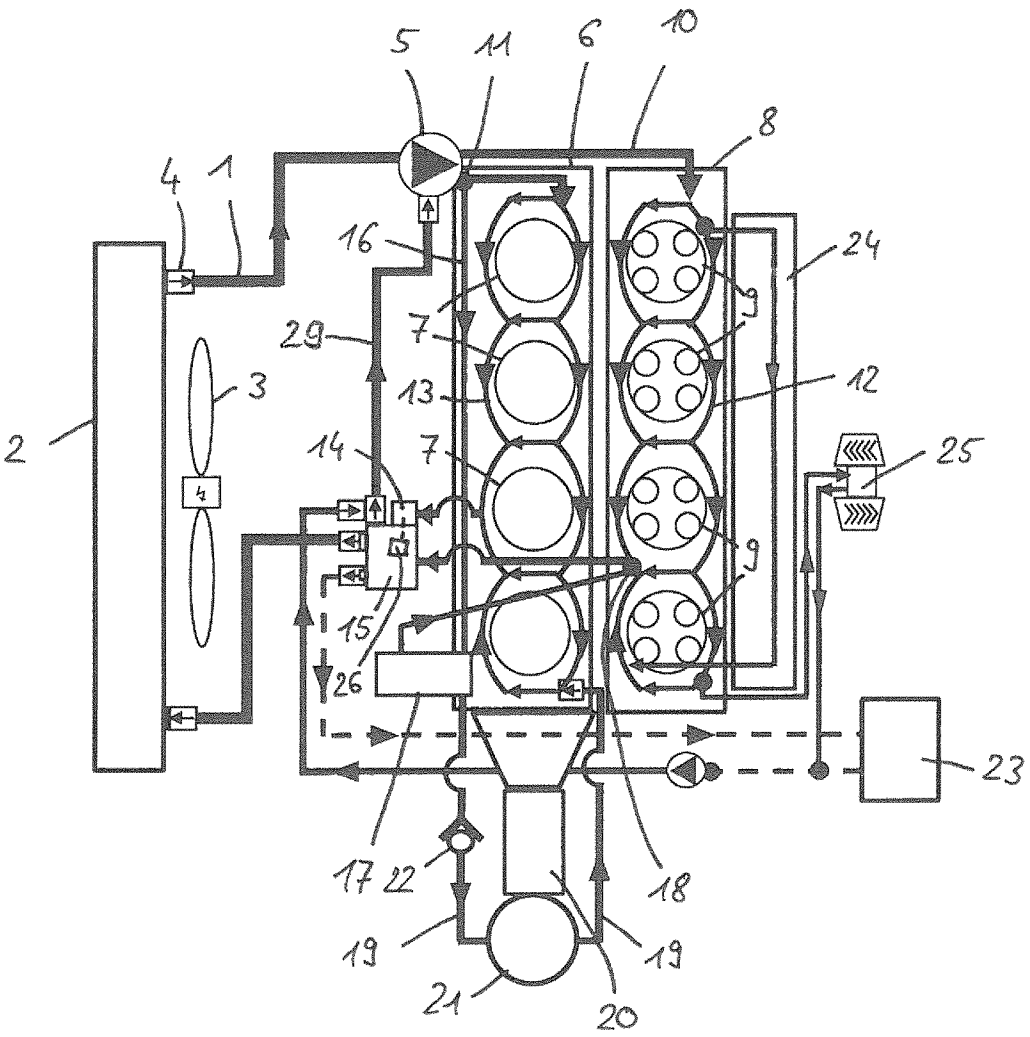
FIG. 2 is a schematic view of a second embodiment of the coolant circuit according to the present invention.

FIG. 2 is a schematic view of a second embodiment of the coolant circuit according to the present invention. In FIG. 2, the same reference numerals indicate identical or similar components and reference may be made to the description of the first embodiment in order to prevent repetition. Only differences with respect to the first embodiment are intended to be described here.

Thus, for example, an output of the crank housing water jacket 13 and the cylinder head water jacket 12 is not arranged at the outer end of the respective water jacket, but instead is arranged in the region of the penultimate cylinder bore or cylinder head, whereby the flow relationships change slightly in the respective water jacket, as illustrated by corresponding flow arrows.

The preferred embodiment of the device 21 is a transmission oil heat exchanger, but may also be the water jacket which has already been described in the first embodiment.

In the second embodiment, there is additionally provided a bypass line 29 via which the heat management module 15 can bypass the radiator 2 where necessary. For example, in order to achieve more rapid heating of the coolant.

A heating heat exchanger 23 is connected to the heat management module 15 and is, where necessary, supplied from the heat management module 15 with coolant which is guided downstream of the heating heat exchanger 23 back to the heat management module 15 again.

A cooling circuit for cooling a cylinder-head-integrated manifold 24 is connected in parallel with the cylinder head water jacket 12. A cooling circuit for an exhaust gas turbocharger 25 is connected between an outer end of the cylinder head water jacket 12 and an output of the heating heat exchanger 23.

The engine cooling circuit 16 corresponds to the transmission cooling circuit 19 since, as illustrated in FIG. 2, the engine oil heat exchanger 17 is arranged upstream and in a state connected in series with respect to the device 21. This engine oil cooling circuit 16 or transmission cooling circuit 19 branches off downstream of the coolant pump 5 (or the branch) and upstream of the input of the crank housing water jacket 13. However, the invention is not limited thereto so that the engine oil cooling circuit 16 and the transmission cooling circuit 19 may both extend parallel with each other, wherein both branch off downstream of the coolant pump 5 (or the branch) and upstream of the input of the crank housing water jacket 13 and both open again into the crank housing water jacket 13.

For the sake of completeness, it should be mentioned that in FIG. 2 the connections between the engine oil water heat exchanger 17 and the location 18 and between the location 18 and the heat management module 15 do not have any contact locations with respect to the engine cooling circuit 16 or the cylinder housing water jacket 13.

Figure 3:
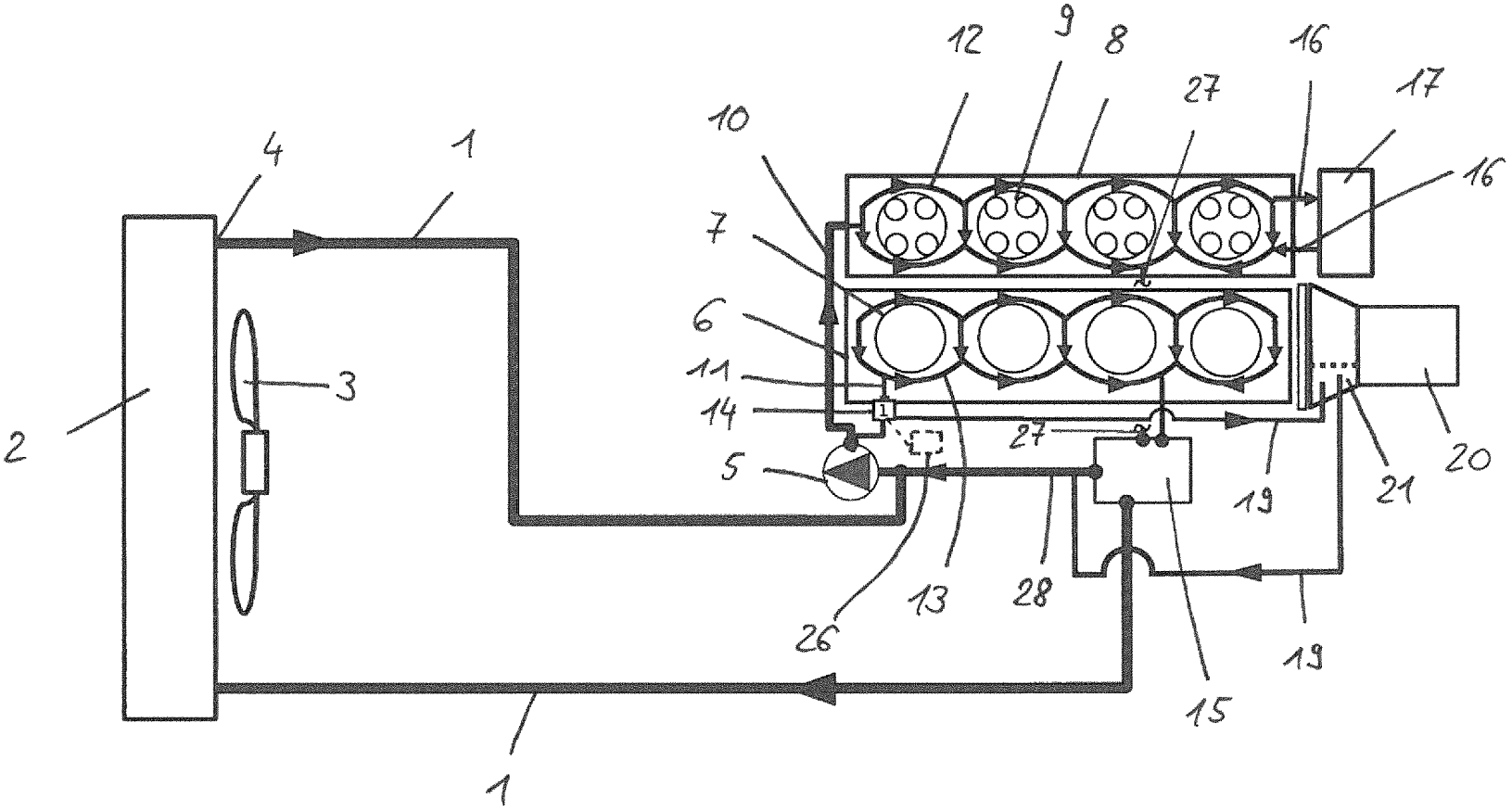
FIG. 3 is a schematic view of a third embodiment of the coolant circuit according to the present invention.

FIG. 3 is a schematic view of a third embodiment of the coolant circuit 1 according to the present invention. In FIG. 3, the same reference numerals indicate identical or similar components and reference may be made to the description of the previous embodiments if not described otherwise below.

The cooling circuit 1 comprises, as in the previous embodiments, an engine cooling circuit, which has a cylinder head cooling circuit 10 and a crank housing cooling circuit 11. The cylinder head cooling circuit 10 and the crank housing cooling circuit 11 preferably extend together as an engine cooling circuit through the radiator 2. Downstream of the radiator 2, the engine cooling circuit is divided at the coolant pump 5 or the branch into the portions of the cylinder head cooling circuit 10 and the crank housing cooling circuit 11, which portions extend separately from each other. After flowing through the respective water jackets 12 and 13, the cylinder head cooling circuit 10 and the crank housing cooling circuit 11 are merged again, for example, in the heat management module 15, and lead back to the radiator 2 again.

In the embodiment according to FIG. 3, the branch into the cylinder head cooling circuit 10 and the crank housing cooling circuit 11 is provided at the coolant pump 5 or downstream thereof. From the branch, the cylinder head cooling circuit 10 leads through the cylinder head water jacket 12 and from there via an output line 27 into the heat management module 15. The engine oil cooling circuit 16 is, in this embodiment, coupled to the cylinder head cooling circuit 10. More specifically, the engine oil cooling circuit 16 branches off from the cylinder head water jacket 12 and is guided back into the cylinder head water jacket 12 again at a downstream location of the cylinder head water jacket 12. After the branching-off from the cylinder head water jacket 12, the engine oil cooling circuit 16 consequently flows through the engine oil water heat exchanger 17 and opens again in the cylinder head water jacket 12. With regard to the engine oil water heat exchanger 17, reference may be made to the description of the preceding embodiments.

Between the branch into the cylinder head cooling circuit 10 and the crank housing cooling circuit 11, on the one hand, and the input of the crank housing water jacket 13, on the other hand, or, in other words, downstream of the branch and upstream of the crank housing water jacket 13, the transmission cooling circuit 19 branches off. The input of the crank housing water jacket 13 is defined as the location at which the crank housing circuit 13 first opens after entering the crank housing into a hollow space which surrounds a cylinder in a closed manner. The valve 14 is provided at the location at which the transmission cooling circuit 19 branches off from the crank housing cooling circuit 11. The valve 14 is preferably an electric valve, but may also correspond to one of the above-mentioned embodiments. In particular, the valve 14 forms the branch of the transmission cooling circuit 19 from the crank housing cooling circuit 11. The valve 14 may, in accordance with a flow, permit or prevent a flow of coolant both in the crank housing cooling circuit 11 and in the transmission cooling circuit 19. Intermediate positions are also possible. Alternatively, the valve 14 may be arranged in the embodiment illustrated in FIG. 3 upstream of the location at which the transmission cooling circuit 19 branches off from the crank housing circuit 11 and downstream of the branch into the cylinder head cooling circuit 10, on the one hand, and crank housing cooling circuit 11, on the other hand. The transmission cooling circuit 19 leads, branching off from the crank housing cooling circuit 11, to the device 21 for absorbing heat from the transmission 20. This device 21 and the transmission 20 were explained in the above embodiments. Downstream of the device 21, the transmission cooling circuit 19, as illustrated, opens in a connection line 28 which connects an output of the heat management module 15 to the engine cooling circuit upstream of the branch into the cylinder head cooling circuit 10 and crank housing cooling circuit 11. However, it is also possible for the transmission cooling circuit 19 to open downstream of the device 21 in the heat management module 15 or directly in the engine cooling circuit downstream of the heat management module 15.

Alternatively, the embodiment illustrated in FIG. 3 may be modified in such a manner that the valve 14 is arranged in the crank housing cooling circuit 11 (on the portion which extends separately from the cylinder head cooling circuit 10) downstream of the crank housing water jacket 13 and the transmission cooling circuit 19 opens downstream of the device 21 in the crank housing water jacket 13. Consequently, the same effect as explained above in connection with FIG. 3 or in connection with the preceding embodiments would be able to be achieved, that is to say that a switching-off of the crank housing cooling circuit 11 by means of the valve 14 automatically also switches off the transmission cooling circuit 19 and a switching-on of the crank housing cooling circuit 11 by means of the valve 14 automatically also switches on the transmission cooling circuit 19. In other words, the coolant flows through the transmission cooling circuit 19 (that is to say, is active) only when it also flows through the crank housing cooling circuit 11 (that is to say, is active) and is independent of whether it flows through the cylinder head cooling circuit 10 (that is to say, is active).

Other embodiments of the invention which are not illustrated in the drawings are described below. Reference may be made to the description of the previous embodiments and only the differences are discussed.

The transmission cooling circuit 19 may, for example, also branch off from the cylinder head cooling circuit 10 between the coolant pump 5 (or the branch) and the cylinder head water jacket 12. The effect that the transmission cooling circuit 19 is activated independently of the crank housing cooling circuit 11 may also be implemented in this arrangement by the transmission cooling circuit 19 opening in the crank housing cooling circuit 11 and being switched downstream of this opening by the valve 14, as described above.

As mentioned above, the coolant pump 5 may also be arranged in such a manner that a branch is provided in the cylinder head cooling circuit 10 and cylinder housing cooling circuit 11 downstream of the coolant pump 5. It would then also be possible to branch off the transmission cooling circuit downstream of the coolant pump 5 and upstream of the branch.

Furthermore, the transmission cooling circuit 19 would not necessarily have to be directed into the cylinder housing water jacket 13. The transmission cooling circuit 19 could also be directed directly into the heat management module 15 or into the output of the cylinder head water jacket 12. In this instance, however, the valve 14 with the above-described function would have to be provided in the transmission cooling circuit so that the flow in the transmission cooling circuit 14, that is to say, only the flow in the transmission cooling circuit, can be switched as described above.

It has been described above that the engine cooling circuit has a cylinder head cooling circuit 10 and a crank housing cooling circuit 11, wherein over a specific portion the cylinder head cooling circuit 10 and the crank housing cooling circuit 11 extend together, are then divided, extend separately from each other over a respective portion, and are then merged again. However, the invention is not limited thereto and the two cooling circuits 10 and 11 could also extend completely separately.

In the embodiment illustrated in FIG. 1, the engine oil cooling circuit 16 extends in a manner branching off from the crank housing cooling circuit 11 as far as the location 18 in the crank housing, that is to say, in a channel formed in the crank housing material. The transmission cooling circuit 19 also extends in a manner branching off from the crank housing cooling circuit 11 as far as the engine oil water heat exchanger 17 in the crank housing. However, this embodiment is not limited thereto and the mentioned portions which extend in the crank housing may also extend outside the crank housing, as is the case, for example, in FIG. 3.

In the embodiment illustrated in FIG. 2, the engine oil cooling circuit 16 and the transmission cooling circuit 19 extend in a manner branching off together from the crank housing cooling circuit 11 as far as a location downstream of the engine oil water heat exchanger 17 and upstream of the non-return valve 22 in the crank housing, that is to say, in a channel which is formed in the crank housing material. However, this embodiment is not limited thereto and the mentioned portions which extend in the crank housing may also extend outside the crank housing, as is the case, for example, in FIG. 3.

In the embodiment illustrated in FIG. 3, the transmission cooling circuit 19 extends from the valve 14 or, in a manner branching off from the crank housing cooling circuit 11, as far as the device 21 outside the crank housing, that is to say, outside the crank housing material. However, this embodiment is not limited thereto and the mentioned portion of the transmission cooling circuit 19 may also extend at least partially in the crank housing, that is to say, in a channel formed in the crank housing material.

Furthermore, the invention discloses, according to an embodiment, a control method for a coolant circuit 1 having an engine cooling circuit 10, 11 in which coolant can be circulated in order to cool an internal combustion engine 6, 8; having a transmission cooling circuit 19 for cooling a transmission 20, which transmission cooling circuit 19 branches off from the engine cooling circuit 10, 11; having a valve 14 which is arranged in the transmission cooling circuit 19, wherein the valve 14 is opened and closed in accordance with an operating state of the engine and/or the transmission.

According to another embodiment, the valve 14 is opened and closed in accordance with an engine speed and/or an engine torque.

According to another embodiment, the valve 14 is opened only above a specific threshold value of the engine speed and/or the engine torque.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A coolant circuit, comprising:

an engine cooling circuit in which coolant is circulated in order to cool an internal combustion engine, the engine cooling circuit branching into a cylinder head cooling circuit and a crank housing cooling circuit at a bifurcation;

a transmission cooling circuit for cooling a transmission, which transmission cooling circuit branches off from the crank housing cooling circuit upstream of a merging point between the branched cylinder head cooling circuit and crank housing cooling circuit;

a valve which is arranged in the transmission cooling circuit; and a control which is adapted to open and close the valve in accordance with an operating state of the internal combustion engine and/or the transmission.

2. The coolant circuit as claimed in claim 1, wherein the crank housing cooling circuit has a crank housing water jacket which is guided around cylinder bores, and the transmission cooling circuit opens in the crank housing water jacket downstream of a device for absorbing heat from the transmission.

3. The coolant circuit as claimed in claim 2, wherein the valve is located downstream of the crank housing water jacket.

4. The coolant circuit as claimed in claim 3, wherein downstream of the valve, the cylinder head cooling circuit and the crank housing cooling circuit are merged together.

5. The coolant circuit as claimed in claim 1, wherein the transmission cooling circuit branches off from the crank housing cooling circuit downstream of the bifurcation and upstream of a crank housing water jacket of the crank housing cooling circuit.

6. The coolant circuit as claimed in claim 5, wherein the crank housing cooling circuit branches off downstream of the bifurcation into a crank housing water jacket and an engine oil cooling circuit which is adapted to cool an engine oil via a heat exchanger, and the transmission cooling circuit branches off from the engine oil cooling circuit.

7. The coolant circuit as claimed in claim 1, wherein the crank housing cooling circuit branches off downstream of the bifurcation into a crank housing water jacket and an engine oil cooling circuit which is adapted to cool an engine oil via a heat exchanger, and the transmission cooling circuit branches off from the engine oil cooling circuit.

8. The coolant circuit as claimed in claim 1, wherein a non-return valve is provided in the transmission cooling circuit.

9. The coolant circuit as claimed in claim 1, wherein the bifurcation is formed by a coolant pump.

10. The coolant circuit as claimed in claim 5, wherein the bifurcation is formed by a coolant pump.

11. The coolant circuit as claimed in claim 1, wherein the control is adapted to open and close the valve in accordance with an engine speed and/or an engine torque.

12. The coolant circuit as claimed in claim 11, wherein the control is adapted to open the valve only above a specific threshold value of the engine speed and/or the engine torque.

13. A motor vehicle comprising a coolant circuit as claimed in claim 1.

* * * * *